US005353494A

United States Patent [19]

Bisbee et al.

[11] Patent Number: 5,353,494

[45] Date of Patent: Oct. 11, 1994

[54] METHOD FOR ASSEMBLING A DISTRIBUTION TRANSFORMER WITH CONFORMING LAYERS

[75] Inventors: Phillip I. Bisbee; Eric S. Richardson, both of Versailles; Stephen D. Smith, Lawrenceburg, all of Ky.

[73] Assignee: Kuhlman Corporatin, Lexington, Ky.

[21] Appl. No.: 970,712

[22] Filed: Nov. 3, 1992

[51] Int. Cl.[5] ..... H01F 41/08

[52] U.S. Cl. ..... 29/605; 336/84 M; 336/209; 336/221

[58] Field of Search ..... 29/605; 336/84 M, 209, 336/221; 242/4 R, 6

[56] References Cited

U.S. PATENT DOCUMENTS

| | | | |
|---|---|---|---|
| 1,586,889 | 6/1926 | Elmen | 29/605 X |
| 2,191,393 | 11/1937 | Humphreys . | |
| 2,519,277 | 8/1950 | Nesbitt et al. | 29/605 X |
| 3,063,135 | 11/1962 | Clark | 29/605 |
| 3,247,750 | 3/1966 | Collins | 29/605 X |
| 3,340,489 | 9/1967 | Bastis et al. . | |
| 3,766,641 | 10/1973 | Metzler et al. | 29/605 |
| 4,381,600 | 5/1983 | Mas . | |

FOREIGN PATENT DOCUMENTS 642616 6/1962 Canada .

*Primary Examiner*—Carl E. Hall

*Attorney, Agent, or Firm*—Townsend & Townsend Khourie & Crew

[57] ABSTRACT

A distribution transformer (58) is assembled using a core (18) having a core surface (36) including an inner circumferential surface (40) defining an open eye region (38), an outer circumferential surface (42), and end surfaces (24, 26). Wedged-shaped core supports (20, 22), secured to the end surfaces of the core, are used to support the core during conductor winding operations and to mount the finished transformer within a transformer container (66). The core supports do not extend into the open eye region and allow virtually the entire inner circumferential surface to be covered by the electrical conductors (34, 56). The layers of electrical conductors are wound on top of one another so that each successive layer of electrical conductors conforms to the core surface and any previously wound conductors. Electrical insulation (54) is provided between each conductor layer.

23 Claims, 2 Drawing Sheets

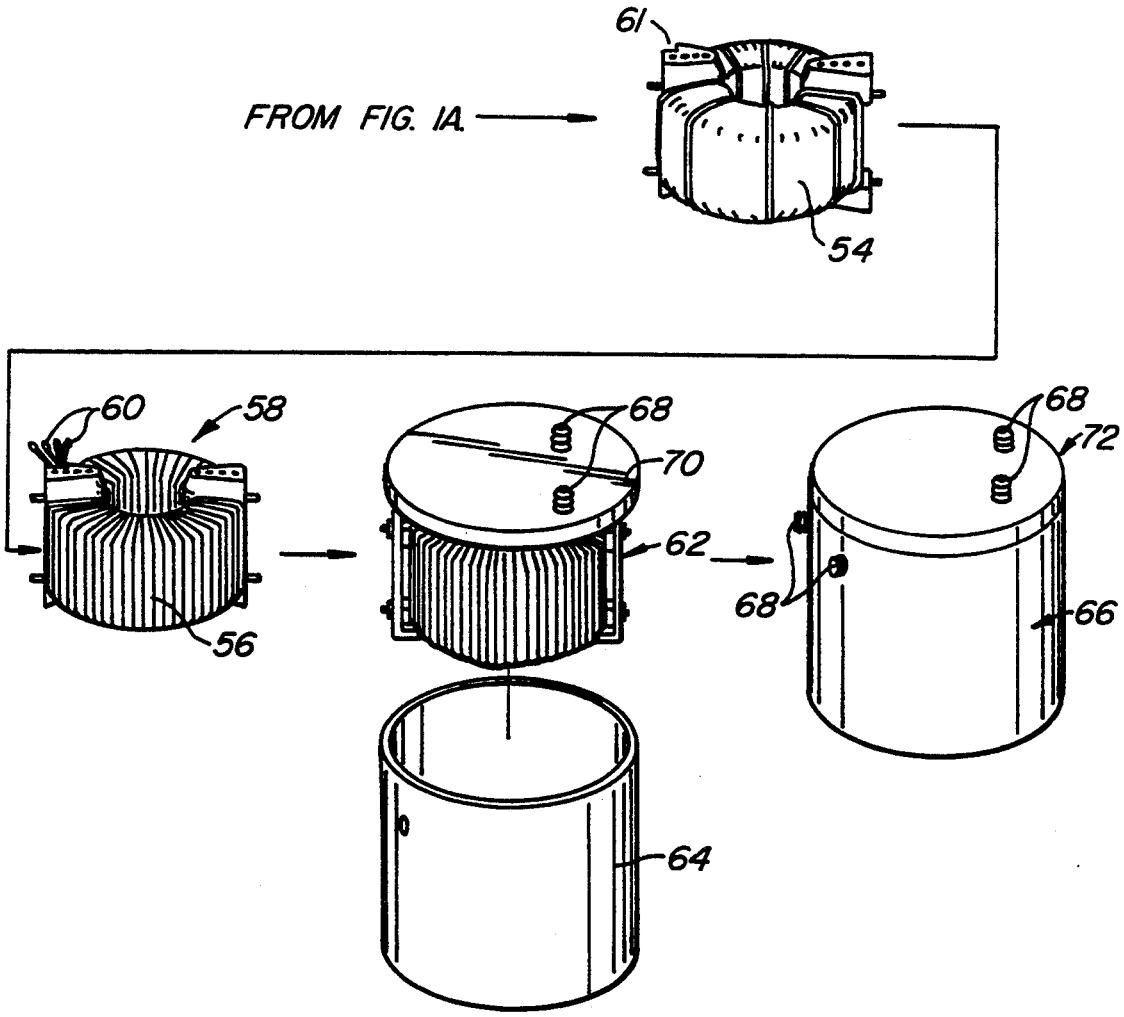
FIG. IB.

METHOD FOR ASSEMBLING A DISTRIBUTION TRANSFORMER WITH CONFORMING LAYERS

BACKGROUND OF THE INVENTION

Distribution transformers are relatively large electrical transformers, typically between 10 Kva and 50 Kva, commonly used to reduce voltage from 2000-25,000 volts to 110/220 volts for residential and commercial use. Because of the large amount of electricity handled by distribution transformers, efficiency is of prime concern in their design.

There are several methods for winding electrically conductive coils for distribution transformers. In one method, a series of coils is wound separately. A strip of core material is then wound through the center of the coils. See, for example, U.S. Pat. No. 2,191,393 to Humphreys, U.S. Pat. No. 4,381,600 to Mas, and U.S. Pat. No. 4,741,484 to Curtis, the disclosures of which are incorporated by reference. This method is not now used to any substantial extent. Another method, extensively used for commercial production of distribution transformers, proceeds by winding the coil onto a winding form or mandrel apart from the magnetic core. The winding form or mandrel defines the size and shape of the opening in the coil. The core is subsequently inserted through the opening in the coil. See, for example, U.S. Pat. No. 3,340,489 to Bastis, the disclosure of which is incorporated by reference.

There are disadvantages to both of these prior art methods. First, there must be working clearance between the core and the coil. Second, the coil opening must be sized to accommodate the maximum core size, allowing for normal manufacturing tolerances. Third, the first method requires that the coil have a maximum radius of the core cross section, plus a working clearance for winding the coil onto the bobbin. Fourth, the second method requires that the magnetic circuit be cut and opened for insertion into the coil, and then reclosed.

Enlargement of the coil opening to accommodate different size cores requires that the electrical conductors be longer to obtain the same number of turns. Inefficiency, or load loss, of the transformer is directly affected by the conductor length. Therefore, the required spacing between the electrical conductors and the core results in less efficient transformers.

Another problem, referred to above, relates to variation in the dimension of the magnetic core. Magnetic cores are necessarily layered structures with certain space between the laminations. For certain types of materials, such as amorphous magnetic core material available from Allied Signal, Morristown, New Jersey as Metglas TCA, the manufacturer stipulates a range of void space from up to 30%. However, for a fixed cross section of a magnetic core, having a specified level of magnetic induction, the gross cross section of the core would vary by +11% to −11%.

Two cores can have the same magnetic cross section; however, the core which is more tightly spaced, so that there is less void space between the layers, will have a higher gross density. The core having a lower gross density will necessarily have a longer mean magnetic path and will have greater weight of energized magnetic core material. This results in increased core loss proportional to the increase in weight. To reduce the core loss, more magnetic material may be added to reduce the magnetic flux density for an offsetting value.

This, however, compounds the variation in the gross cross section of the material +18% to −13%.

Specific core loss of magnetic core materials also varies within a certain percentage from the mean. This variation can be offset by decreasing the magnetic flux density or by increasing the amount of material in the core. This, of course, adds further variation to the gross cross section of the core.

It has been found that a conventionally wound distribution transformer using a spool of Metglas TCA magnetic core material requires that, using conventional distribution transformer manufacturing techniques, the inner perimeter of the coil be designed about 10% larger than a nominal size to accommodate variations in the size of the core. As discussed above, doing so lowers the efficiency and thus increases the cost of use of the distribution transformer.

SUMMARY OF THE INVENTION

The present invention is directed to a method for assembling a distribution transformer using conforming layers. The invention accommodates the wide range of core dimensions associated with transformer cores, especially variations that arise from the use of spools of amorphous magnetic material as the transformer core, by winding the conductors directly onto the core. The invention also minimizes transformer size by insuring that each layer, including conductors and insulating layers, conform to the underlying layers to produce an optimally conforming fit of the conductor coils to the core for each unit manufactured.

The distribution transformer is assembled using a core having a core surface including an inner circumferential surface, defining an open eye region, an outer circumferential surface and end surfaces connecting the inner and outer circumferential surfaces. The core is typically a spool of magnetic core material so that the transformer created is a toroidal transformer.

The core preferably has wedged-shaped core supports secured directly to the end surfaces. The core supports are used to support the core during conductor winding operations and to mount the finished transformer within the transformer container. The wedged-shaped core supports are shaped and configured so that they do not extend, to any substantial degree, into the open eye region; this allows virtually the entire inner circumferential surface to be covered by the electrical conductors.

The layers of electrical conductors are wound on top of one another so that each successive electrical conductor layer conforms to the core surface and any previously wound conductors. Electrical insulation is provided between layers. The insulation is flexible so that the insulation does not hinder the conformance of outer windings onto the inner windings.

The assembled transformer is preferably mounted to a transformer support bracket using the core supports. The combination transformer and transformer support bracket is housed within a transformer container to create the finished transformer assembly.

One of the primary advantages of the invention is that the electrical conductors can be wound against substantially the entire inner circumferential surface of the core. This helps minimize transformer size and enhances efficiency. Also, by eliminating core supports from the eye of the core, movement of cooling transformer oil, or other cooling fluid, through the eye of the transformer is not obstructed for enhanced cooling efficiency.

Another advantage of the invention is that it eliminates many of the prior art manufacturing steps and structures, such as mandrels, bobbins, winding forms and other equipment, associated with prior art distribution transformer core manufacture. With the present invention variations in the size of the core translate directly into variations in the length of the conductors. However, each conductor will be only so long as is necessary for that particular core.

Another advantage of the invention is achieved by the use of wedged-shaped core supports. The core supports are sized to not interfere with the winding of the conductors along the inner circumferential surface of the core. The wedged-shape core supports are sized and shaped to not substantially diminish the necessary space for the conductor along the outer circumferential surface of the core as well as the end surfaces of the core.

Other features and advantages of the invention will appear from the following description in which the preferred assembly method has been discussed in detail in the accompanying drawings.

BRIEF DESCRIPTION OF THE DRAWINGS

FIGS. 1A and 1B constitute a simplified view illustrating the various steps in the assembly of a distribution transformer according to the invention.

DESCRIPTION OF THE PREFERRED METHOD

Figure 1A:
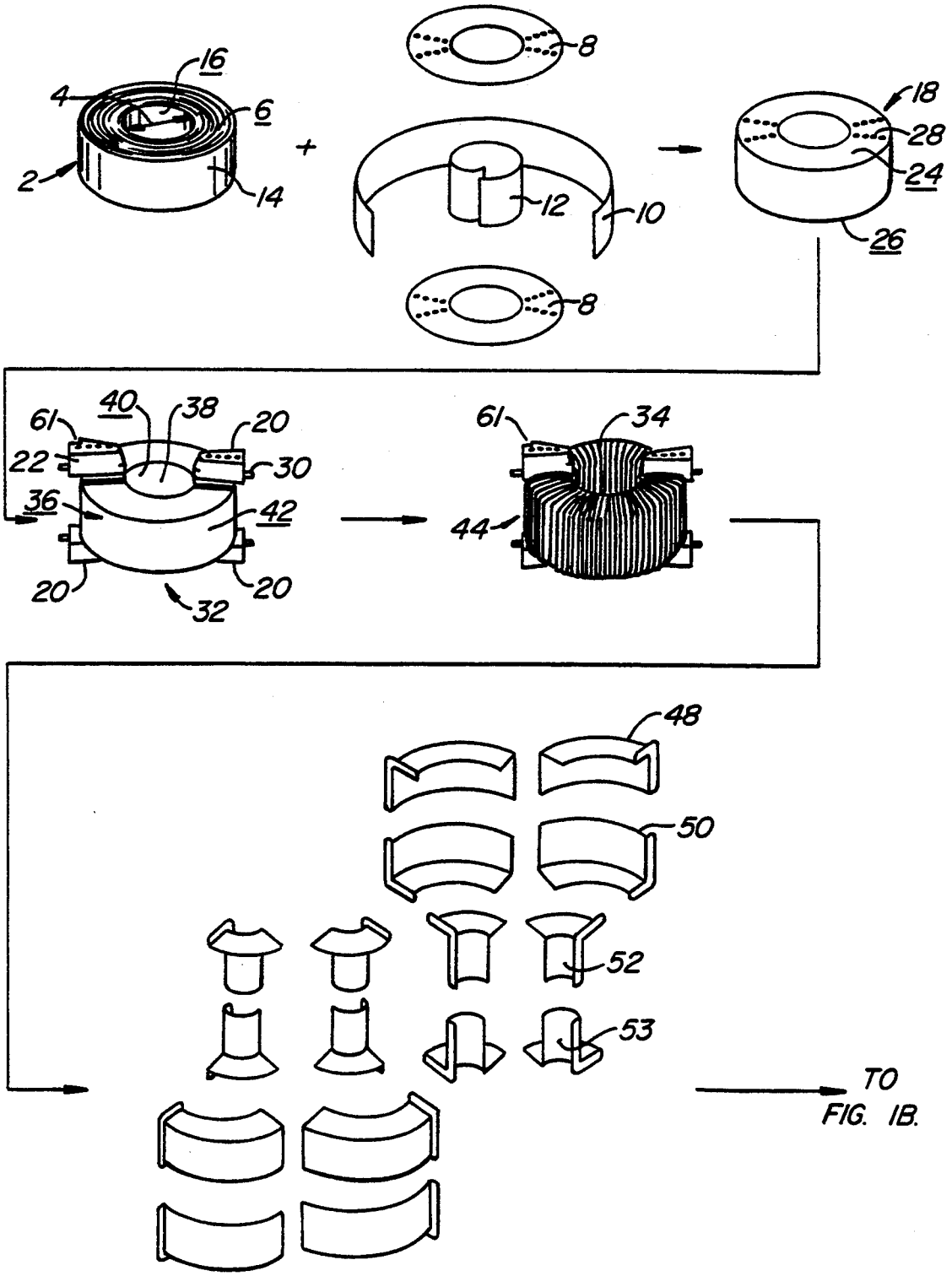

FIGS. 1A and 1B illustrate, in simplified form, the various steps taken to assemble a distribution transformer made according to the invention. A spool 2 of amorphous magnetic material made by Allied Signal as Metglas TCA is wound about a mandrel having the desired diameter 4. Spool 2 is then annealed as recommended by the manufacturer to relieve stresses, created when spool 2 is wound from a much larger supply spool of the material, and to enhance its magnetic characteristics. To keep the spool 2 from unwinding and to strengthen and rigidify the spool, an adhesive is applied to the ends 6 of spool 2. Adhesive is not applied over the entire surface of ends 6 so that air trapped between the layers of the core material can escape when the spool is emersed in a transformer oil and subjected to a vacuum as discussed below. This finishing and rigidifying of spool 2 is disclosed in more detail in U.S. patent application No. 07/820,708 filed Jan. 14, 1992 and entitled "Transformer Core And Method For Finishing," the disclosure of which is incorporated by reference.

Spool 2 is further protected by bonding fluid permeable pressboard to spool 2. The pressboard is in the form of two circular disks 8 and two strips 10, 12 which are secured to the ends 6 of spool 2, the outer circumferential surface 14 of spool 2 and the inner circumferential surface 16 of the spool. U.S. patent application No. 07/820,708 describes this technique in more detail.

Finished/stabilized core 18 then has four wedged-shaped core supports 20, 22 secured to upper and lower core surfaces 24, 26 of core 18 through the use of an epoxy-type adhesive. To accommodate the bonding of the adhesive to spool 2 as well as pressboard 8, pressboard 8 has series of holes 28 formed therein to allow the epoxy-type adhesive to flow to and bond directly to spool 2 of amorphous core material. The adhesive also passes into the spaces between the layers of the core material for additional bonding effectiveness. Core supports 20, 22 are made of an electrically insulating, reinforced plastic resin, such as Valox 414 made by General Electric Company. Core supports 20, 22 preferably have mounting studs 30 extending radially therefrom for mounting the finished transformer within a transformer container, as discussed below. Core supports 20, 22 are sized so that together they cover at most about 15% to 25% of upper and lower end surfaces 24, 26. Core supports 20, 22 are discussed in more detail in U.S. patent application No. 07/970,713, filed on the same day as this application, titled "Core Support Blocking for Toroidal Transformers" and assigned to the assignee of this application, the disclosure of which is incorporated by reference.

Combination 32 of core 18 and core supports 20, 22 has a first conductor 34 wound directly onto the core surface 36 of core 18. This is preferably accomplished using a toroidal winding machine using core supports 20, 22 to support core 18 during winding operations. Toroidal winding machines are shown in U.S. Pat. Nos. 3,383,059 and 3,459,385, both to Fahrbach, and are sold by Universal Manufacturing Co., Inc. of Irvington, N.J. 07111. First conductor 34 passes through the eye 38 of core 18, eye 38 being defined by the inner circumferential surface 40 of core 18. Conductor 34 is also wound around and against upper and lower core surfaces 24, 26 and outer circumferential surface 42 of core 18. Thus, conductor 34 is wound in a generally helical fashion with the turns of conductor 34 along inner circumferential surface 40 lying generally adjacent to one another while, due to the larger diameter of outer circumferential surface 42, the turns of conductor 34 are spaced apart somewhat along surface 42. See U.S. Pat. No. 4,917,318 to Schlake, the disclosure of which is incorporated by reference.

The wedge-shaped core supports 20, 22 are sized so they do not extend into eye 38. Core supports 20, 22 are also sized so that substantially the entire inner circumferential surface 40 can be covered by turns of first conductor 34 for maximum efficiency. After first conductor 34 has been wound onto core 18, the terminal ends 44 of first conductor 34 are secured in place near one of core supports 20, 22.

Insulation is applied over first conductor or winding 34 to electrically isolate the first conductor from the next conductor to be wound directly on top of the first conductor. This is achieved using a set of 16 creped kraft preforms 46-53. Preforms 46-53 each have an L-cross-sectional shape and reinforced (thickened) corners and are secured to the combination of core 18 and first conductor 34 using an adhesive tape to keep the preforms in position. The use of insulation layer 54 permits the second conductor or winding 56 to be wound on top of insulation layer 54 instead of on first conductor 34. This process of winding an electric conductor onto core 18 and placement of insulation layer 54 between the layers of electric conductors, typically high voltage windings, is repeated as often as necessary. The use of insulation layer 54 is especially critical between low and high voltage windings. Insulation layer 54, or a simplified version of it using only four preforms 46-53, is also necessary between the layers of high voltage windings. A single sheet of insulation material can often be used between the layers of low voltage windings. U.S. patent application No. 07/971,000 filed on the same day as this application and entitled "Toroidal Transformer Insulation Preforms", the disclosure of which is incorporated by reference, describes the shape and use of preforms 46-53 in more detail.

After each layer of windings, the terminal ends 44 are coupled together as appropriate for the particular transformer being constructed. Certain terminal ends 44 are secured together to be directed away from the assembled transformer as leads 60. As can be seen in FIG. 1, core support 22 has a cut-out 61 to permit the upward routing of leads 60.

Assembled transformer 58 is then mounted to a transformer support bracket 62, as shown in the above-mentioned U.S. patent application for Core Support Blocking for Toroidal Transformer, through the use of mounting studs 30 on core supports 20, 22. Assembled transformer 58 and bracket 62 are placed within and secured within the base 64 of a transformer container 66. Leads 60 are connected to terminals 68 mounted to top 70 of transformer container 66. Transformer assembly 72 is preferably subjected to a vacuum to drive out any air and moisture trapped within assembled transformer 58 so to replace the trapped air and moisture with insulating fluid, such as transformer oil. Transformer container 66 is then sealed and transformer assembly 72 is tested prior to use.

Modification and variation can be made to the disclosed method without departing from the subject of the invention as defined in the following claims. For example, core 18 could be other than cylindrical. Assembled transformer 58 could be mounted directly to base 64 of transformer container 66 instead of through the intermediate use of support bracket 62. Other types of insulation, such as spiral wrap creped kraft paper, could be used. Also, in some cases it may be desired to dip a partially assembled transformer assembly into a liquid insulating material between each conductor layer to provide a coat of insulation between each conductor layer. The insulation layer could also be brushed on. A combination of brushed on and creped kraft paper could be used, especially with the creped kraft paper being used at the corners of the partially assembled transformer. Spool 2 could be made of magnetic core material other than amorphous magnetic core material.

What is claimed is:

1. A method for assembling a distribution transformer comprising:

assembling a core having a core surface, the core surface including an inner circumferential surface defining an open eye region, an outer circumferential surface, and first and second end surfaces connecting the inner and outer circumferential surfaces;

selecting a core support capable of supporting the weight of the assembled distribution transformer, the core support having a first portion and a second portion;

fixedly securing the first portion of the core support to at least one of the end surfaces of the core, and thereafter;

winding a first conductor directly onto the core surface by:

passing the first conductor through the open eye region;

directing the first conductor against the core surface; and conforming the first conductor to the core surface;

providing electrical insulation to the first conductor;

winding a second conductor directly onto the electrical insulation by:

passing the second conductor through the open eye region;

directing the second conductor against the electrical insulation and any exposed core surface; and conforming the second conductor to the electrical insulation and said any exposed core surface; and maintaining the second portion of the core support free of overlying material.

2. The method of claim 1 wherein the core assembling step is carried out by assembling a toroidal core having a cylindrical eye region and annular first and second end surfaces.

3. The method of claim 1 wherein the core assembling step is carried out by:

winding a spool of magnetic core material;

mechanically stabilizing said spool of magnetic core material so as not to unwind; and covering said mechanically stabilized spool of magnetic core material with a layer of material.

4. The method of claim 3 wherein the covering step is carried out using a fluid permeable, electrically insulating material.

5. The method of claim 1 further comprising the step of limiting the amount of said first and second end surfaces covered by the core support to at most 25% of the first and second end surfaces.

6. The method of claim 1 wherein the core support securing step is carried out maintaining the open eye region substantially free of said core support.

7. The method of claim 6 wherein the first conductor winding step includes the step of covering essentially the entire inner circumferential surface with said first conductor.

8. The method of claim 7 wherein the second conductor winding step includes the step of covering essentially all of the first conductor lying against the inner circumferential surface with the second conductor.

9. The method of claim 1 wherein the electrical insulation providing step includes the step of placing a layer of electrical insulation material on the first conductor after the first conductor winding step.

10. The method of claim 9 wherein the layer of electrical insulation material has thicker regions and thinner regions to accommodate different levels of mechanical and electrical stresses.

11. A method for assembling a distribution transformer comprising:

assembling a core having a core surface, the core surface including an inner circumferential surface defining an open eye region, an outer circumferential surface, and first and second end surfaces connecting the inner and outer circumferential surfaces;

securing a core support to at least one of the end surfaces of the core, said core support securing step being carried out by securing a wedge-shaped core support directly to the core;

winding a first conductor directly onto the core surface by:

passing the first conductor through the open eye region;

directing the first conductor against the core surface: and conforming the first conductor to the core surface;

providing electrical insulation to the first conductor; and winding a second conductor directly onto the electrical insulation by:

passing the second conductor through the open eye region;

directing the second conductor against the electrical insulation and any exposed core surface; and conforming the second conductor to the electrical insulation and said any exposed core surface.

12. The method of claim 11 wherein the securing step is carried out by securing at least one of the wedge-shaped core supports to each of the first and second end surfaces.

13. The method of claim 12 wherein the securing step is carried out by securing at least two of said wedge-shaped core supports to each of the first and second end surfaces.

14. The method of claim 13 further comprising the step of limiting the amount of said first and second end surfaces covered by the core supports to at most 25% of the first and second end surfaces.

15. A method for assembling a distribution transformer comprising:

assembling a core having a core surface, the core surface including an inner circumferential surface defining an open eye region, an outer circumferential surface, and first and second end surfaces connecting the inner and outer circumferential surfaces, the core assembling step being carried out by:

winding a spool of magnetic core material;

mechanically stabilizing said spool of magnetic core material so as not to unwind; and covering said mechanically stabilized spool of magnetic core material with a layer of material;

securing wedge-shaped core supports to the first and second end surfaces of the core;

limiting the amount of said first and second end surfaces covered by the core support to at most 25% of the first and second end surfaces;

maintaining the open eye region substantially free of said core support;

winding layers of conductors directly onto the core surface and any underlying previously-wound conductor layers by:

passing the conductors through the open eye region;

directing the conductors against the core surface and said any underlying previously-wound conductor layers;

conforming the conductors to the core surface and said any underlying previously-wound conductor layers; and covering essentially the entire inner circumferential surface with each said conductor layer; and providing a layer of electrical insulation between at least two of said layers of conductors.

16. A method for assembling a distribution transformer assembly comprising the following steps:

assembling a core having a core surface, the core surface including an inner circumferential surface defining an open eye region, an outer circumferential surface, and first and second end surfaces connecting the inner and outer circumferential surfaces;

securing core supports to the core;

winding layers of conductors directly onto the core surface and any underlying previously-wound conductor layers by:

passing the conductors through the open eye region;

directing the conductors against the core surface and any said underlying previously-wound conductor layers; and conforming the conductors to the core surface and said any underlying previously-wound conductor layers;

providing electrical insulation between at least two of said conductor layers, said assembling, securing, winding and providing steps creating a distribution transformer;

securing the core supports of the distribution transformer to transformer support structure;

mounting the distribution transformer and transformer support structure within a transformer container; and connecting the first and second conductors to electrical terminals carried by the transformer container.

17. The method of claim 16 wherein the securing step is carried out by securing the core supports to a support bracket.

18. The method of claim 17 wherein the mounting step is carried out by securing the support bracket to the transformer container.

19. The method of claim 16 further comprising the step of introducing transformer oil into the transformer container so that the distribution transformer is completely immersed in the transformer oil.

20. The method of claim 19 further comprising the steps of heating the transformer oil and subjecting the heated transformer oil to a partial vacuum.

21. The method of claim 20 further comprising the step of sealing the transformer container.

22. A method for assembling a distribution transformer comprising:

assembling a core having a core surface, the core surface including an inner circumferential surface defining an open eye region, an outer circumferential surface, and first and second end surfaces connecting the inner and outer circumferential surfaces, the core assembling step being carried out by:

winding a spool of magnetic core material;

mechanically stabilizing said spool of magnetic core material so as not to unwind; and covering said mechanically stabilized spool of magnetic core material with a layer of material;

securing wedge-shaped core supports to the first and second end surfaces of the core;

limiting the amount of said first and second end surfaces covered by the core support to at most 25% of the first and second end surfaces;

maintaining the open eye region substantially free of said core support;

winding layers of conductors directly onto the core surface and any underlying previously-wound conductor layers by:

passing the conductors through the open eye region;

directing the conductors against the core surface and said any underlying previously-wound conductor layers;

conforming the conductors to the core surface and said any underlying previously-wound conductor layers; and covering essentially the entire inner circumferential surface with said conductor layers;

providing electrical insulation between the conductor layers;

securing the core supports to transformer support structure;

mounting the core, core supports, layers of conductors and transformer support structure within a transformer container; and connecting the conductor layers to electrical terminals carried by the transformer container.

23. A method for assembling a distribution transformer comprising:

assembling a core having a core surface, the core surface including an inner circumferential surface defining an open eye region, an outer circumferential surface, and first and second end surfaces connecting the inner and outer circumferential surfaces;

securing a core support to at least one of the end surfaces of the core;

winding a first conductor directly onto the core surface by:

passing the first conductor through the open eye region;

directing the first conductor against the core surface; and conforming the first conductor to the core surface;

providing electrical insulation to the first conductor by placing a layer of electrical insulation material on the first conductor after the first conductor winding step, the layer of electrical insulation material being made from a set of L-shaped insulation preforms with thicker regions and thinner regions to accommodate different levels of mechanical and electrical stresses; and winding a second conductor directly onto the electrical insulation by:

passing the second conductor through the open eye region;

directing the second conductor against the electrical insulation and any exposed core surface; and conforming the second conductor to the electrical insulation and said any exposed core surface.

* * * * *